US005579024A

United States Patent [19]

Sureau

[11] Patent Number: 5,579,024

[45] Date of Patent: Nov. 26, 1996

[54] ELECTROMAGNETIC ENERGY SHIELD

[75] Inventor: Jean-Claude Sureau, Boston, Mass.

[73] Assignee: Radant Systems, Inc., Stow, Mass.

[21] Appl. No.: 642,536

[22] Filed: Aug. 20, 1984

[51] Int. Cl.[6] ..... H01Q 15/02; H01Q 15/14

[52] U.S. Cl. ..... 343/909; 343/912

[58] Field of Search ..... 343/909, 700 MS, 343/722, 873, 834, 912, 754, 756

[56] References Cited

U.S. PATENT DOCUMENTS

| | | | |
|---|---|---|---|
| 3,276,023 | 9/1966 | Dorne et al. | 343/754 |
| 3,708,796 | 1/1973 | Gilbert | 343/909 |
| 3,864,690 | 2/1975 | Pierrot | 343/909 |
| 4,017,865 | 4/1977 | Woodward | 343/909 |
| 4,126,866 | 11/1978 | Pelton | 343/909 |
| 4,160,254 | 7/1979 | Wise | 343/909 |
| 4,266,203 | 5/1981 | Saudreau et al. | 343/756 |
| 4,450,449 | 5/1984 | Jewitt | 343/700 MS |

*Primary Examiner*—Gregory C. Issing
*Attorney, Agent, or Firm*—Ernest V. Linek, Esq.

[57] ABSTRACT

A "shutter" type structure for transmitting electromagnetic energy within a selected frequency range and preventing the transmission of such energy outside such range during a first open shutter mode of operation and for preventing the transmission of any electromagnetic energy during a second closed shutter mode of operation. The structure includes an insulative member having an array of symmetrical conductive elements on at least one surface, such elements being interconnected by diode elements in both vertical and horizontal directions. The diodes are placed in their conductive states during the first mode of operation and in their non-conductive states during the second mode of operation.

12 Claims, 3 Drawing Sheets

ELECTROMAGNETIC ENERGY SHIELD

INTRODUCTION

This invention relates generally to structures for selectively transmitting electromagnetic energy and, more particularly, to electronic circuit structures arranged so that at selected times the transmission of electromagnetic energy therethrough is permitted only in a selected frequency range and at other times the transmission therethrough of energy in such selected frequency range is substantially reduced. Such structures can be used, for example, as special radomes for shielding microwave antennas and other auxiliary equipment from external incident energy.

BACKGROUND OF THE INVENTION

Radome structures are conventionally used to protect microwave antennas from the physical environment. It is also desirable to shield such equipment from external incident electromagnetic energy which can adversely affect the electrical operating characteristics thereof. Such a shield, during the operation of the antenna equipment, should be transparent to the energy only in the selected frequency range handled by the antenna equipment. However, when the antenna equipment is not operating, such a shield should reject electromagnetic energy within such frequency range as well as outside such frequency range.

Radome shields having such characteristics are often referred to as "shutter-type" radomes, the shutter being effectively "closed" to all frequencies both within and outside the frequency band of interest during non-operation and the shutter being effectively "open" only to frequencies in the desired operating frequency band during operation.

One proposed shutter arrangement is described in currently copending U.S. patent application Ser. No. 512,260 of Jean-Claude Sureau filed Sep. 7, 1982. Such structure can be effectively described as a "transmission resonant" shutter which operates in a manner such that during a first operating mode (i.e., an "open" shutter mode) energy is permitted to be transmitted through the structure within a selected frequency range, the shutter panel thereof being essentially resonant during such transmission mode. During the second operating mode (the "closed" shutter mode) the shutter panel is non-resonant and transmission of energy both over the selected frequency range and outside the selected frequency range is substantially small.

Another proposed shutter arrangement is described in U.S. patent application Ser. No. 527,029 filed by Jean-Claude Sureau on Aug. 9, 1983. Such structure can be effectively described as a "non-resonant" shutter structure which operates so that during a first operating mode (the "open" shutter mode) transmission is permitted over a relatively wide range of frequencies, normally arranged to extend from the low end of the frequency spectrum to a selected higher frequency. Transmission is substantially prevented above the selected frequency. During such mode, the shutter panel does not operate as a resonant structure. During the second operating mode (the "closed" shutter mode) the structure prevents the transmission of energy substantially over the entire frequency spectrum and again does not operate as a resonant structure.

While the above structures have their uses in certain applications, the structures are relatively expensive since they utilize a relatively large number of diodes for the shutter structure and operation. Moreover, during the closed shutter mode the suppression of energy transmission may not be adequate in applications which require a greater degree of energy suppression, particularly in the specific selected frequency range of interest.

It is desirable, therefore, to provide a structure which has improved suppression characteristics over a selected frequency range in the "closed" shutter mode and to provide such operation at reduced cost over that provided by the previous systems.

BRIEF SUMMARY OF THE INVENTION

In contrasting the approach of the invention with the previously proposed approaches discussed above, the invention can be effectively described as a "suppression resonant" structure. In accordance therewith, transmission is permitted in the "open" shutter mode over a relatively wide frequency band which is generally established as being substantially wider than the particular frequency band of interest. During such mode the structure is essentially operating as a non-resonant structure. In the "closed" shutter mode the structure is made essentially resonant at the center frequency of the desired selected frequency band so as to effectively suppress all transmission at such center frequency and to substantially reduce the energy in the remaining portion of the selected frequency band about the center frequency. The structure then can be said to operate as a suppression resonant (a band reject) structure so as to suppress transmission to a much greater extent in the selected frequency range than that achieved in the previous systems.

Such a structure can be utilized in conjunction with a filter structure which permits transmission over a very accurately defined selected frequency band so that the combination of the filter structure with the suppression resonant shutter structure in accordance with the invention provides an effective overall structure for permitting transmission only within such frequency band during operation and for preventing the transmission of substantially all energy in such frequency band during non-operation, i.e., when the shutter is closed.

Such operation is achieved by utilizing a symmetrical pattern of symmetrical conductive elements which are interconnected both in the horizontal and vertical directions with diodes, the diodes being appropriately biased in the conductive direction during the "open" shutter mode and in the non-conductive direction during the "closed" shutter mode.

DESCRIPTION OF THE INVENTION

The invention can be described in more detail with the help of the accompanying drawings wherein.

Figure 1:
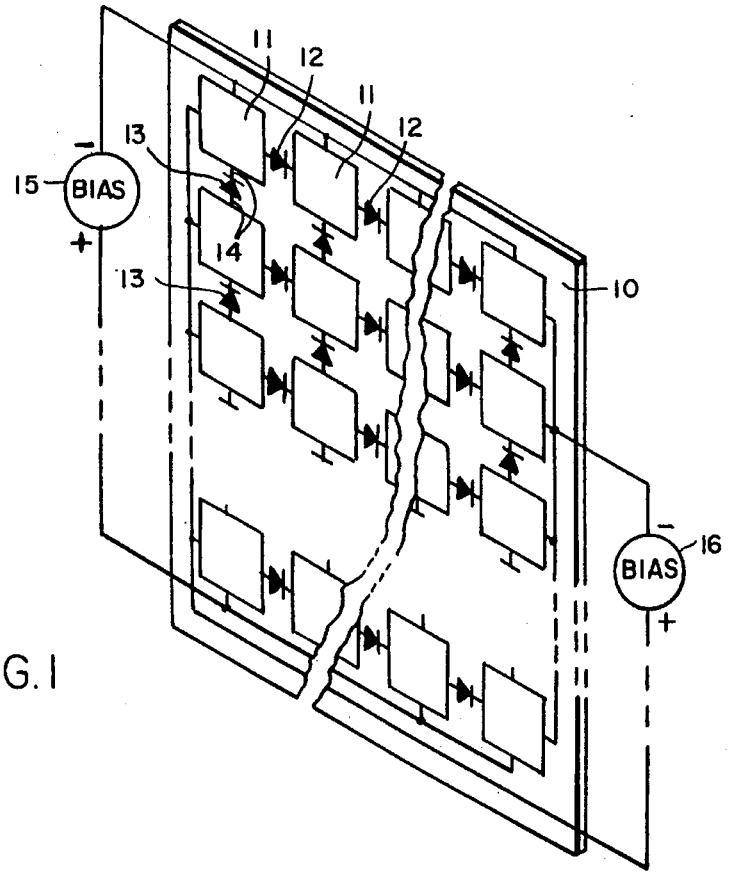
FIG. 1 depicts an embodiment of the structure of the invention.

FIG. 1 shows a panel constructed in accordance with invention wherein the panel comprises a substrate 10 made of appropriate material, such as Teflon fiberglass, on which are deposited a plurality of conductive, e.g. metal, elements, or patches, 11 each of which is symmetrical in its configuration. As shown herein, the elements 11 have a square configuration, although in some applications it may be desirable to make them circular in shape, for example, or even in the shape of other polygons. The metallic elements 11 are separated by diodes 12 in the horizontal direction and by diodes 13 in the vertical direction, polarized as shown, the overall configuration thereby forming a generally symmetrical metal element/diode array substantially over the entire face of the substrate. The diodes are connected to the metallic elements via appropriate metallic strips, or wires, 14. The diodes may be of a conventional PIN type, as would be well known in the art. The vertical diodes 13 are all effectively connected to a vertical biasing voltage source 15 while the horizontal diodes are all effectively connected to a horizontal biasing voltage source 16.

Figure 2:
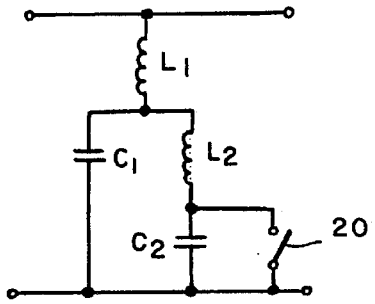
FIG. 2 depicts an equivalent circuit of the structure of FIG. 1.

The operation of the overall symmetrical grid of metallic elements and diodes can be explained on the basis of the equivalent circuit therefor, as shown in FIG. 2. The equivalent circuit comprises a first inductance, identified as $L_1$, in series with a first circuit comprising a capacitance element, identified as $C_1$, and a second circuit parallel to the first circuit and comprising series connected inductance $L_2$ and capacitance $C_2$. The biasing arrangement for diodes 12 and 13 of FIG. 1 can be effectively considered as equivalent to the operation of a switch 20, the switch being in the closed position when the diodes are all forward-biased, i.e. biased in a conductive direction, and being in an open position when the diodes are reversed-biased, i.e. biased in a non-conductive direction. As used herein the term reverse-biased represents either the application of voltage which causes the diodes to be non-conductive, e.g., a zero or a negative voltage thereacross.

The inductance $L_1$ represents the relatively small inductance of the metal elements 11, while the capacitance $C_1$ represents the capacitance of the gaps between such elements. The inductance $L_2$ represents the inductance of the metallic strips or wires 14 contacting the grid elements, while the capacitance $C_2$ represents the capacitance of the PIN diodes in the reverse (or unbiased) state. When the diodes are forward, or conductively, biased, each of the diodes operates effectively as a short circuit. The equivalent circuit of FIG. 2 represents only the inductance and capacitance representations thereof and for purposes of explanation does not include the ohmic losses in the circuit (resistive elements thereof), particularly of the diodes or any of the parasitic circuits associated therewith. Such equivalent circuit however is adequate to provide an understanding of the mechanisms which are involved in the shutter operation described below and also provide a guidance into the selection of the dimensions of the physical structure for use in a practical embodiment of the invention.

When the diodes are all forward biased (switch 20 is effectively closed in the equivalent circuit) a parallel resonance is created between the circuit formed by elements $L_2$ and $C_1$ (inductance $L_1$ is sufficiently small in comparison therewith as to not affect the desired resonance) so as to create in effect a bandpass circuit which will transmit electromagnetic energy only within a selected frequency range. Under such conditions a relatively low loss of energy occurs in the selected pass band so that electromagnetic energy within such pass band will be readily transmitted through the panel. Such operation corresponds to the "open" mode of operation for the shutter structure depicted. Transmission outside the pass band is considerably reduced.

When the diodes are unbiased, or reverse-biased (i.e., non-conductive), the switch 20 is effectively opened in the equivalent circuit and a series resonance occurs primarily between inductances $L_2$ and $C_2$ so as to create in effect a stop-band, the frequency range of the stop-band being somewhat modified by the presence of $L_1$ and $C_1$. Such operation will in effect create a suppression resonance (band reject) circuit that is at the center of a desired pass band in the open mode of operation. Accordingly, no energy is transmitted at the resonant frequency and substantially little energy is transmitted throughout the rest of the stop-band. Such operation corresponds to the "closed" shutter mode of operation.

The use of diodes in both the horizontal and vertical direction will provide a 90° symmetry of the array pattern so that the operation of the overall panel tends to be relatively independent of the polarization of the energy which impinges on the panel. To provide for the independent DC bias voltages to the horizontally oriented diode array and to the vertically oriented diode array the structure can also be in the form depicted in FIG. 3 wherein a first plurality of metallic grid elements 11 (shown in solid lines) is formed on one side of the insulative substrate panel 10 having the horizontal diodes connected therebetween and a second plurality of identical metallic grid elements 11A (shown in dashed lines) are correspondingly positioned on the other side of insulative substrate panel 10 and have vertically oriented diodes connected therebetween. Bias source 16 is supplied to the horizontal diodes on the front panel and bias source 15 is supplied to the vertical diodes on the other side of the panel.

Figure 3:
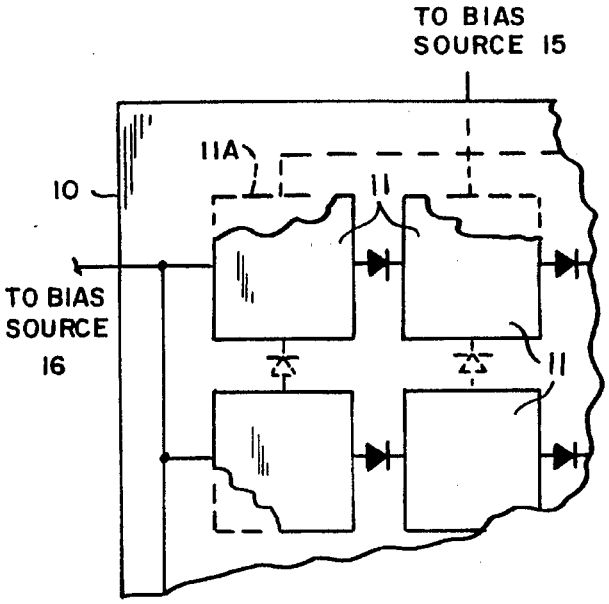
FIG. 3 depicts an alternative embodiment of the structure of the invention.
Figure 4:
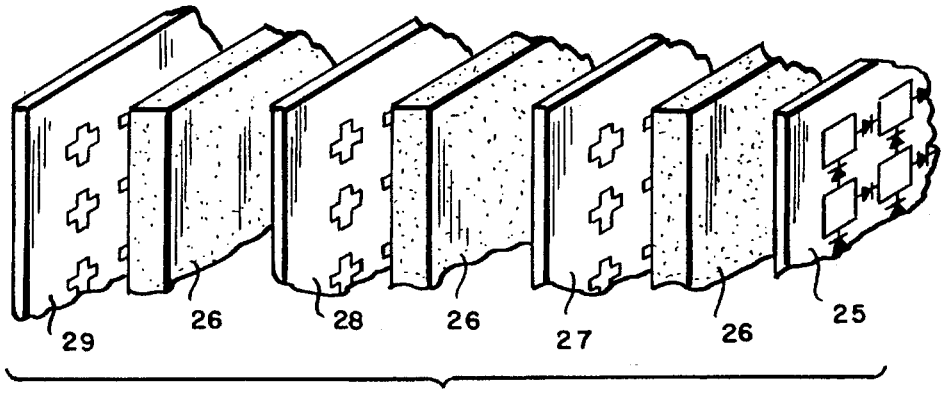
FIG. 4 depicts an exploded view of a structure using an embodiment of the invention in combination with a plurality of passive filter structures.

The structures shown in FIGS. 1 or 3 can be utilized in combination with one or more further panels each of which is arranged to provide a passive bandpass filter operation, as would be well known in the art. Such structures are shown utilizing metallized surfaces having non-metallized cross slots therein, for example, the slots having various cross configurations and dimensioned appropriately for such purpose. One particular embodiment thereof is described, for example, in concurrently filed and copending application, Docket No. 35331, entitled "Electromagnetic Energy Shield," Ser. No. 642,076, filed by Jean-Claude Sureau on the same day as this application. Such panel structures provide passive filtering operation which at all times permits the transmission of energy only within a particular frequency band and substantially prevents the transmission of energy therethrough at frequencies outside such specified frequency pass band range. An exemplary overall combination thereof is shown in FIG. 4 wherein the shutter structure of the invention is depicted as panel 25, which panel is separated from a suitably designed passive filter panel 27 by a low density foam (or alternatively by a non-metallic honeycomb) structure 26. Multiple layers of bandpass filter panels containing any desired number of panels, e.g., the three panels 27, 28 and 29, as shown, separated by similar structures 26 may be utilized as shown in FIG. 4 so as to shape the pass band characteristics of the overall passive filter as required.

Figure 5:
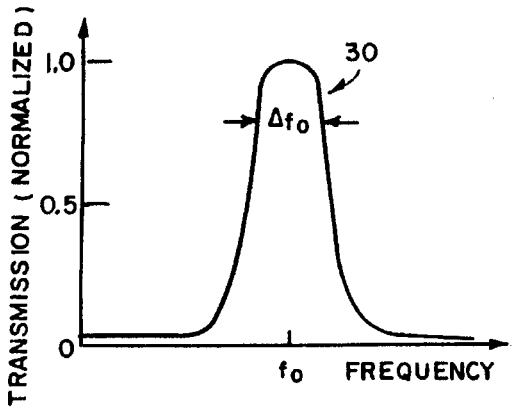
FIG. 5 depicts a graph showing the characteristics of the passive filter structure of FIG. 4.

As shown in FIG. 5, the transmission characteristics of the one or more passive bandpass filter panels are defined by a pass band 30, designated as having a frequency range $\Delta f_0$, which is centered about a center frequency $f_0$, effectively all the energy within such frequency pass band being transmitted (full transmission being represented by the normalized transmission coefficient 1.0) and substantially little or no energy being transmitted outside the pass band.

Figure 6:
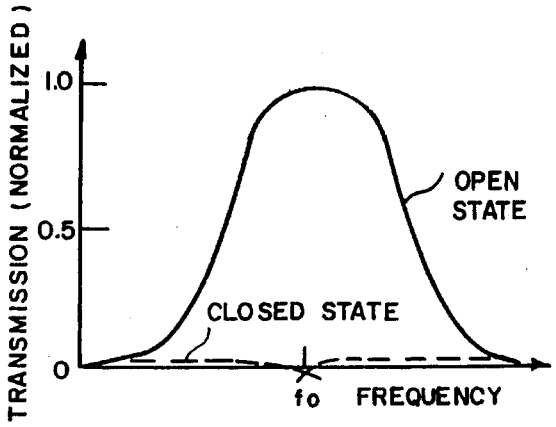
FIG. 6 depicts a graph showing the characteristics of the structure of the invention of FIG. 4.
Figure 7:
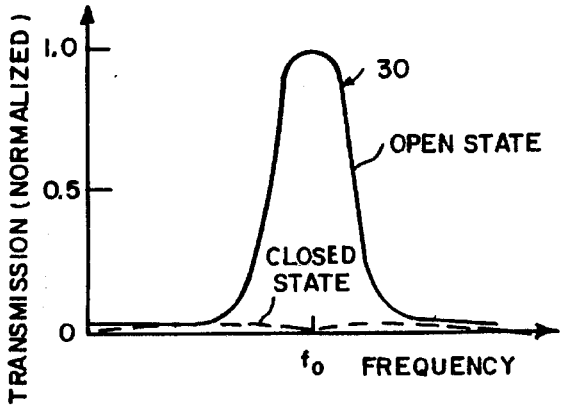
FIG. 7 depicts a graph showing the overall characteristics of the structure of FIG. 4.

The shutter characteristics of panel 25 are depicted in FIG. 6. In the open state, frequencies within the pass band 30 as well as frequencies somewhat outside such pass band over a reasonable frequency range beyond the cut-off frequencies of pass band 30 are substantially fully transmitted. During the closed state, however, frequencies within and outside the pass band 30 are prevented from transmission, as discussed above, the transmisssion of energy at the resonant frequency $f_0$ being essentially zero and that of energy within the pass band 30 being substantially at or close to zero. Accordingly, the combination of the characteristics of the passive filter panel (whether single or multiple panels are used) and the shutter characteristics of the panel formed in accordance with the invention provides an overall operation as shown in FIG. 7 wherein in the open state energy is transmitted only over the desired frequency band 32, defined by the passive filter structure, and substantially little or no energy is transmitted at any frequency when the shutter is closed.

Figure 8:
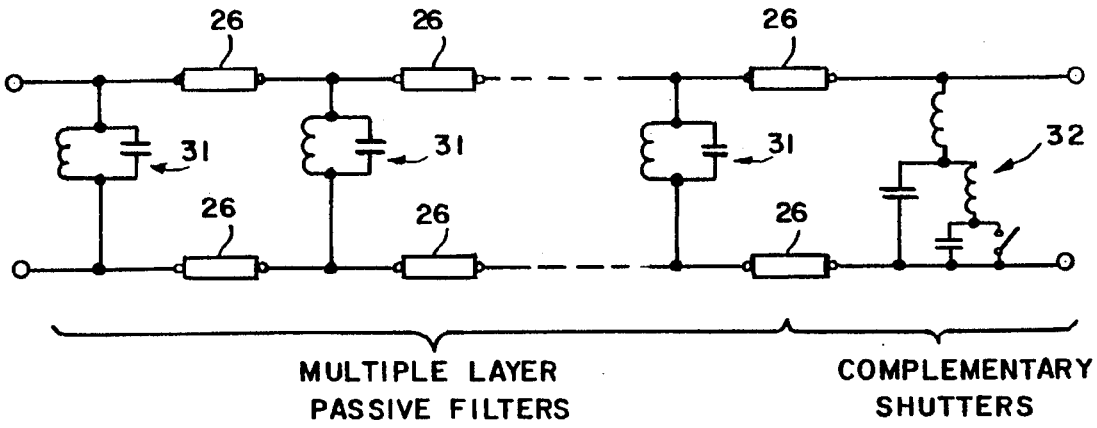
FIG. 8 depicts an overall equivalent circuit of the structure of FIG. 4.

An overall equivalent circuit for a combination of one or more bandpass filters and the complementary "suppression-resonant" shutter in accordance with the invention is shown in FIG. 8. The separation between the panels by the foam, or honeycomb, structures 26 provides the most effective operation if the thickness of the separating structures is approximately equal to $\lambda_0/4$ at the center resonant frequency $f_0$ of the pass band. The pass band filter operation is shown by the tuned circuit configuration 31, while that of the shutter panel operation is shown by circuit 32.

In the most effective operation of the system it is generally desirable that the center frequency of the pass band of the passive filter structure coincide (or substantially nearly coincide) with the center frequency of the stop-band of the shutter panel in the closed shutter mode and with the center frequency of the transmission pass band of the shutter panel in the open shutter mode.

Figure 9:
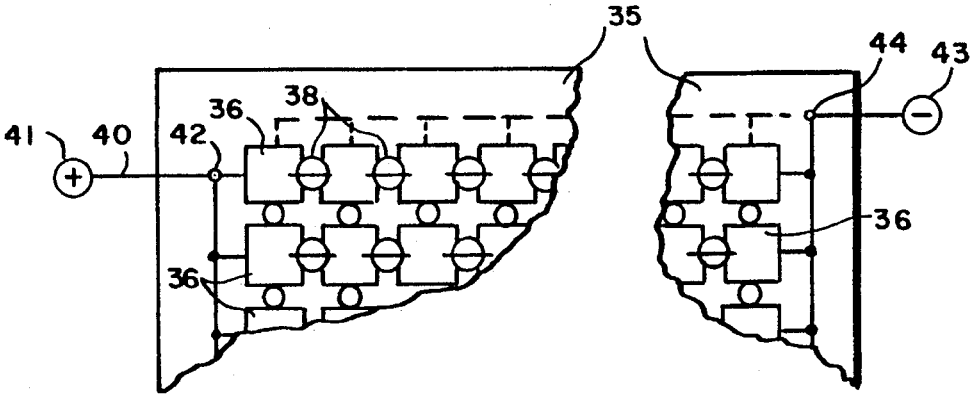
FIG. 9 depicts still another embodiment of the invention.

The dimensions of the elements utilized can be best discussed in connection with FIG. 9 which shows a specific practical embodiment of a portion of a panel in accordance with the invention utilizing the principles and configuration discussed above with respect to the shutter panel. In such embodiment a Teflon fiberglass substrate 35 having a thickness of 10 mils has a dielectric constant of about 2.5 and is of the type, for example, that can be purchased under Model No. 602 from The Laminates Division of Oak Materials Group, Inc. of Franklin, N.H. A metallic layer of copper in the configuration shown is deposited on both the front and back surfaces of the substrate 35 using suitable masking techniques so as to form a symmetric array of square metallic grid elements 36 on the front side of panel 35 and a corresponding symmetrical array of square metallic elements (not shown) on the opposite side thereof. A plurality of first diodes 38 appropriately packaged to permit easy connection to the metal elements 36 are positioned between each elements in the horizontal direction on the front side of panel 35 as shown. The diodes are appropriately packaged PIN diodes, one appropriate diode package being available and sold, for example, under Model No. DP 1005-A-011 by Scientific Devices Incorporated of North Billerica, Mass. Such diode packages are suitably fabricated so as to permit easy soldering to the edges of the deposited metal grid elements as shown.

A plurality of second PIN diodes (not shown) are also suitably soldered to the metallic grid elements on the reverse side of panel 35 in the vertical direction. A first lead 40 from the positive terminal of a biasing source is supplied to the front side of the panel and connected through appropriate metallized leads to the horizontally oriented metal/diode elements thereeon as shown and is further supplied through an appropriate feed-through hole 42 to the reverse side of panel 35 for connection, again through suitable metallized leads, to the vertically oriented metal/diode elements therein. In a similar manner the negative terminal 43 of the bias source is connected to the horizontally oriented metal/diode elements on the front side of panel 35 and through feed through hole 44 to the vertically oriented metal/diode elements on the reverse side of panel 35.

The dimensions of the metal elements 36 are such that the width of the sides thereof is between $\lambda 0/4$ and $\lambda 0/3$, representing the wavelength at the center frequency $f_0$ of the desired stop band. In the particular embodiment depicted, for a center frequency of 10.0 gigahertz (GHz) the width of each of the sides of the square metal elements 31 is 0.371 inches, which in the particular embodiment shown is approximately 0.314 $\lambda 0$.

For such embodiment, the metal elements are separated from each other by 0.079 inches (approximately 0.067 $\lambda 0$). The metallized elements on the faces of panel 35 can be formed by depositing copper thereon using suitable masking techniques, the thickness thereof being approximately 1.4 mils. The diameters of the diode regions are each 0.161 inches.

As discussed above, when the diodes are in their forward biased (conductive) state, the panel is effectively in an open shutter mode and the energy transmission over the desired pass band is maximized (i.e., the transmission loss in the pass band is minimized). When the diodes are in their non-biased, or reverse-biased (non-conductive) state, the panel is in its closed shutter mode and energy transmission over the pass band of interest is minimized and is in effect reduced to zero at the resonant center frequency thereof.

While the embodiments shown and discussed above represent preferred practical embodiments of the invention, modifications thereto may occur to those in the art within the spirit and scope of the invention. Hence, the invention is not to be construed as limited to the particular embodiments described herein except as defined by the appended claims.

What is claimed is:

1. A structure for transmitting electromagnetic energy within a first selected frequency range and for preventing the transmission of electromagnetic energy outside said frequency range during a first mode of operation and for substantially preventing the transmission of any electromagnetic energy during the second mode of operation, said structure comprising an insulative member, a plurality of polygonally-shaped conductive elements positioned in a symmetrical array on at least one surface of said structure, at least a first group of adjacent conductive elements being interconnected by diode elements capable of conduction in a first direction and at least a second group of adjacent conductive elements being interconnected by diode elements capable of conduction along a second direction orthogonal to said first direction, and means for placing all of said diode elements substantially simultaneously in their conductive states in said first mode of operation and for placing all of said diode elements substantially simultaneously in their non-conductive states in said second mode of operation.

2. A structure in accordance with claim 1 wherein all of said conductive elements are symmetrically positioned on one surface of said insulative member and each said conductive element is interconnected to its adjacent conductive elements in both said first and said second directions on said one surface.

3. A structure in accordance with claim 1 wherein said first group of conductive elements are symmetrically positioned on one surface of said insulated member and said second group of conductive elements are symmetrically positioned on another surface of said insulative member oppositely disposed to said one surface, said first group of diode elements being interconnected in said first direction and said second group of diode elements being interconnected in said second direction.

4. A structure in accordance with claims 1, 2 or 3 wherein each of said conductive elements is symmetrically shaped.

5. A structure in accordance with claim 4 wherein each of said conductive elements is square shaped.

6. A structure in accordance with claim 5 wherein the lateral dimensions of said square shaped conductive elements are between $\lambda_0/4$ and $\lambda_0/3$ where $\lambda_0$ is the wave length at the center frequency of said selected frequency range.

7. A structure in accordance with claim 6 wherein each of said conductive elements is separated from the conductive elements adjacent thereto by a distance of approximately 2 $\lambda_0/3$.

8. A structural system for transmitting electromagnetic energy in a first mode of operation within a second, selected frequency range which has a narrower bandwidth than said first selected frequency range and for preventing the transmission of any electromagnetic energy during a second mode of operation, said structural system comprising a first structure in accordance with claim 1; and at least one other structure positioned adjacent said first structure and separated therefrom by an insulating structure, said at least one other structure comprising an insulative member having a metallized surface and a symmetrical array of non-metallized cross slot regions therein, the dimensions of said non-metallized cross slot regions being selected to permit the transmission therethrough of electromagnetic energy within said second selected frequency range but to provide substantially less transmission of electromagnetic energy outside said selected frequency range, whereby electromagnetic energy is transmitted within said second selected frequency range and is prevented from transmission outside said second selected frequency range during said first mode of operation and whereby the transmission of any electromagnetic energy is prevented during said second mode of operation.

9. A structural system in accordance with claim 8 comprising a plurality of said other structures positioned adjacent each other and separated from each other by further insulating structures, at least one of said other structures being positioned adjacent and separated from said first structure by said insulating structure.

10. A structure in accordance with claim 9 wherein said first structure and said other structures are separated from each other by a distance of about $\lambda_0/4$ where $\lambda_0$ is the wave length at the center frequency of said second selected frequency range.

11. A structural system in accordance with claim 10 wherein said separating insulating structures are low density foam structures.

12. A structural system in accordance with claim 10 wherein said separating insulating structures are non-metallic honeycomb structures.

* * * * *